US005364085A

United States Patent [19]

Kennish

[11] Patent Number: 5,364,085

[45] Date of Patent: Nov. 15, 1994

[54] ACCUMULATOR WITH "FIRST PAGE HOLDER" FEATURE

[75] Inventor: James R. Kennish, Chester, Conn.

[73] Assignee: GBR Systems Corporation, Chester, Conn.

[21] Appl. No.: 35,086

[22] Filed: Mar. 22, 1993

[51] Int. Cl.[5] ..... B65H 43/06; B65H 39/10

[52] U.S. Cl. ..... 270/58; 271/258; 271/265

[58] Field of Search ..... 270/58, 59; 271/212, 271/215, 216, 258, 265, 272, 275

[56] References Cited

U.S. PATENT DOCUMENTS

| | | | |
|---|---|---|---|
| 3,744,649 | 7/1973 | Ward, Jr. | 271/212 X |
| 3,871,539 | 3/1975 | Nikkel | 271/212 X |
| 4,067,568 | 1/1978 | Irvine | 271/212 X |
| 4,640,506 | 2/1987 | Luperti et al. | 271/212 |
| 4,765,502 | 8/1988 | Pintsov et al. | 270/55 |
| 4,805,891 | 2/1989 | Luperti et al. | 271/212 |
| 4,925,362 | 5/1990 | Golicz | 271/220 X |
| 5,083,769 | 1/1992 | Young, Jr. | 270/58 X |
| 5,139,149 | 8/1992 | Gerlier | 271/212 X |
| 5,147,092 | 9/1992 | Driscoll et al. | 271/212 X |
| 5,178,379 | 1/1993 | Edwards et al. | 271/220 X |
| 5,244,200 | 9/1993 | Manzke | 271/212 X |

*Primary Examiner*—Edward K. Look
*Assistant Examiner*—John Ryznic
*Attorney, Agent, or Firm*—Stoll, Miskin, Previto & Hoffman

[57] ABSTRACT

An accumulator with First page Hold Feature having an accumulating area and a mechanism for feeding sheets of a first group of sheets to the accumulating area. An identifying mechanism is provided to identify the first sheet of a second group of sheets. The first sheet of said second group is fed but is stopped before the first sheet reaches the accumulating area. In the meantime, the first group of sheets is released from the accumulating area and the first sheet of the second group is then released from its stopped position and fed to the accumulating area.

2 Claims, 1 Drawing Sheet

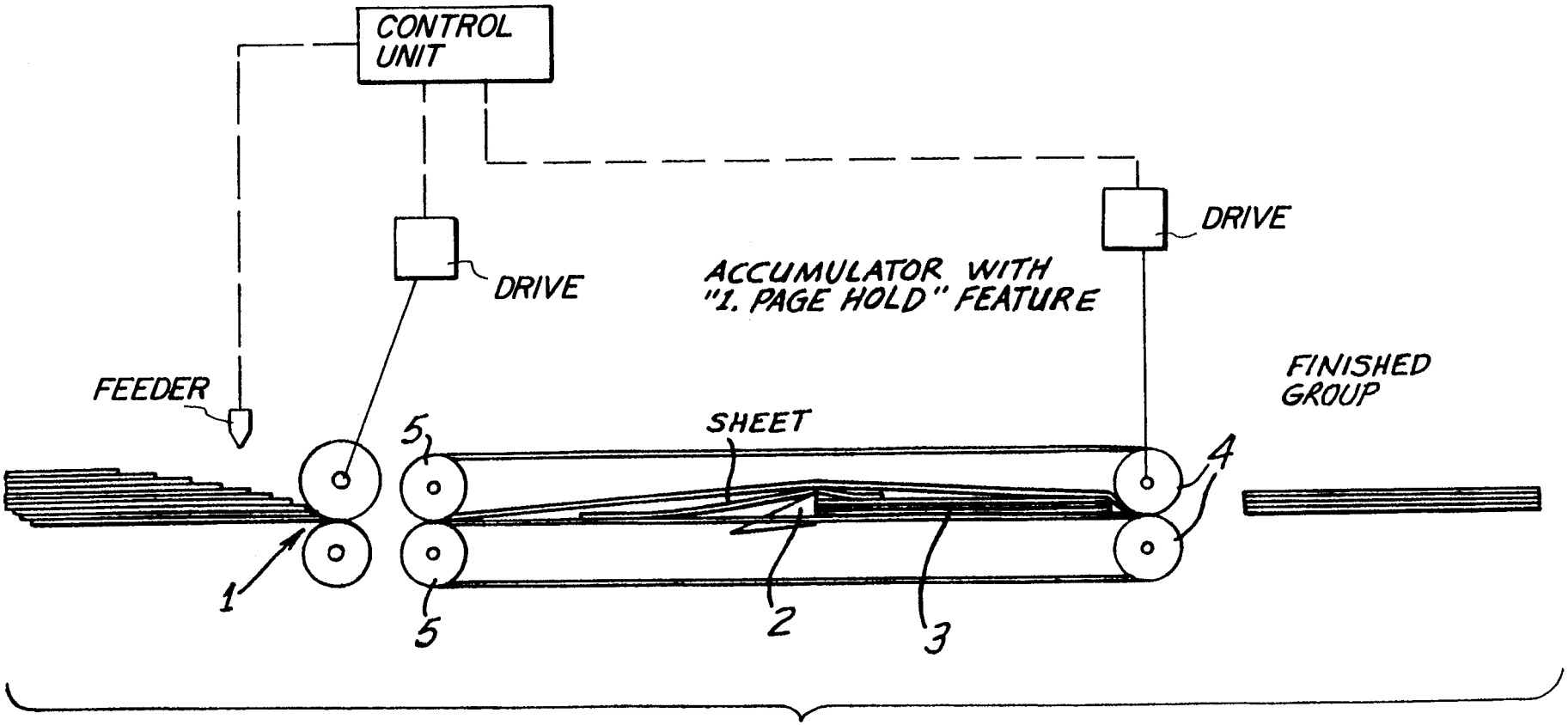
Figure

ACCUMULATOR WITH "FIRST PAGE HOLDER" FEATURE

CURRENT STATE-OF-THE-ART

Based on programming requirements a typical in the mail inserting industry, it is customary to identify individual document groups with optical marks or bar codes, which identify all pages belonging to a particular group. When processing groups in sequence, such optical mark coding may not permit the timely recognition of an end of group, especially when the end of group is supposed to be triggered solely by the appearance of a new group ID, as printed on the next following document.

The industry has dealt with this condition by providing a special module, positioned prior to the actual accumulator, and which would permit the capture of the next following first page in what is referred to as a "first page hold" position until such time that the prior group has vacated the accumulating station.

This practice of extra first page hold positions adds a minimum of a fold document depth, plus additional transport mechanisms to the length of the entire system, let alone increases the cost and complexity of the processing system.

NEW STATE-OF-THE-ART

The invention further on described will not only reduce the required space, but will also permit the retrofitability of such first page hold feature to accumulation systems, which have previously not been fitted with such an extra module as described before.

BRIEF DESCRIPTION OF THE DRAWING

A preferred embodiment of the invention has been chosen for purposes of illustration and description and is shown in the accompanying drawings forming a part of the specification, wherein:

FIG. 1 is a diagrammatic view showing the structure used in connection with the present invention.

Starting with a feeder 1, individual documents are sent to the accumulator area comprised of an accumulator ramp 2 and a document accumulation area 3, as well as the clutched stop rollers 4. In addition, the accumulator features belts driven by a clutched roller pair 5, designed to transport the individual sheets into the accumulator area 3.

Under normal operations, i.e., without first page hold requirements, the feeder issues under optical mark control all documents belonging to one group into the accumulator area 3. Upon the recognition of a completion of the set (this information being contained on the last sheet of the document of the set fed), the clutched stop rollers 4 eject the finished group into the next following work station. The belted transports and rollers 5 are running continuously in such applications since the rollers 5 operate independently of clutched stop rollers 4.

In a scenario where the first page hold requirement has to be dealt with, the before described accumulator arrangement operates as follows:

The normally continuously running rollers 5 and corresponding belts are being clutched and may be operated as and when required. Since this roller pair 5 is also operating the corresponding transport belts, roller pair 5 will, therefore, be in the control of the forward movement of any documents entering the accumulator.

When processing a first page hold OMR scenario, the first group will be issued to the accumulator area 3 until a page appears which identifies itself as the first page of a new group. In this case, the clutched roller pair 5 is energized and stops the document on top or in the area of ramp 2. The first group is now being ejected through the clutched stop rollers 4. The clutched roller 5 starts operation again issuing the first page into the accumulator with all subsequent pages following until again a first page of a new group is recognized and stopped as previously described.

A unique feature of this new concept is the ability to install a clutch onto an existing roller assembly 5, thus converting a field installed system into a first page hold concept system.

It is further envisioned that the drive in the ramp area 2 will be enhanced through the positioning of transport rollers which, in turn, are driven from belts originating from the left roller 5. Such additional transport rollers could function for the increase of drive force in order to both stop the first page document in the desired position, and at the same time to accelerate such document as and when required.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. An accumulator comprising an accumulating area, said accumulating area defined by a rear stop means and front stop means, means for feeding sheets of a first group of sheets to said accumulating area, said feeding means and said accumulating area being on substantially the same plane, each sheet fed by the feeding means adapted to move over said rear stop means and adapted to be deposited over any previously deposited sheet in said accumulating area, means for identifying the first sheet of a second group of sheets, means for feeding said first sheet of said second group toward said accumulating area, means for stopping the feeding of said first sheet of the second group before said first sheet reaches said accumulating area, means for releasing the first group of sheets from said accumulating area, means for releasing the said first sheet of said second group from said stopped position and feeding it to said accumulating area, said stopped position being an area overlying said rear stop means.

2. An accumulator as set forth in claim 1 wherein said rear stop means is a ramp assembly provided in advance of said accumulating area and wherein the sheets being fed by the feeding means move over the said ramp assembly before they reach the accumulating area.

* * * * *